US005401214A

United States Patent [19]

Smollar et al.

[11] Patent Number: 5,401,214

[45] Date of Patent: Mar. 28, 1995

[54] WATER SLIDE AND SPRINKLER

[75] Inventors: Marvin Smollar, Northbrook; Richard B. Mazursky, Glenview, both of Ill.

[73] Assignee: Marchon, Inc., Tarboro, N.C.

[21] Appl. No.: 344,264

[22] Filed: Apr. 27, 1989

Related U.S. Application Data

[63] Continuation-in-part of Ser. No. 212,987, Jun. 29, 1988, abandoned.

[51] Int. Cl.[6] ..... A63G 21/00

[52] U.S. Cl. ..... 472/117; 472/128; 446/489

[58] Field of Search ..... 472/116, 117, 128, 137; 239/597, 598, 523, 524, 276, 590.5; 446/153, 475, 489; 441/66, 40

[56] References Cited

U.S. PATENT DOCUMENTS

| | | | |
|---|---|---|---|
| 695,444 | 3/1902 | Carson . | |
| 1,133,489 | 3/1915 | Mauck . | |
| 2,853,720 | 9/1958 | Friedlander . | |
| 2,982,547 | 5/1961 | Carrier . | |
| 3,301,493 | 1/1967 | Frempter | 239/598 |
| 3,341,133 | 12/1967 | Hruby et al. | 239/598 |
| 3,385,525 | 5/1968 | Jacobs | 239/597 |
| 3,923,301 | 12/1975 | Myers . | |
| 4,339,122 | 7/1982 | Croul . | |
| 4,762,316 | 8/1988 | Merino | 472/117 |
| 5,154,671 | 10/1992 | Smollar et al. | 472/117 |

FOREIGN PATENT DOCUMENTS 2110944A 6/1983 United Kingdom .

*Primary Examiner*—Carl D. Friedman
*Assistant Examiner*—Kien Nguyen
*Attorney, Agent, or Firm*—Laff, Whitesel, Conte & Saret, Ltd.

[57] ABSTRACT

A toy water slide has a long piece of plastic with a surface which is slick when it is wet. An inflatable set of tubes of graduated diameter together form a ramp which is transversely positioned under approximately the longitudinal center of the slide. A spray of water is delivered from each side of the slide toward and over the slide in the vicinity of the ramp, whereby the slide appears to go through a tunnel of water. Graphics are printed on the surface of the slide to provide greater interest to the child.

5 Claims, 4 Drawing Sheets

WATER SLIDE AND SPRINKLER

This is a continuation in part of Ser. No. 02/212,987, filed on Jun. 29, 1988, now abandoned.

This invention relates to yard toys, primarily for pre-teen children and more particularly to water slides.

Water slides of the inventive type are long sheets, perhaps in the order of 25×3-feet, for example, of plastic designed to be staken down in a backyard. Then, the plastic sheet is wetted with water delivered through a garden hose. A child runs up to and belly-flops on it, sliding along the length of the plastic sheet. The child would soon tire of merely sliding; therefore, it is desirable to provide features which gives added interest.

A co-pending U.S. patent application Ser. No. 07/212,897 filed Jun. 29, 1988, features a series of bumps forming a ramp under the water slide at a point leading the child to a splash down pool. The body of a sliding child is lifted by the ramp so that he goes up and splashes down into a pool. Water is sprayed onto the sheet by a special nozzle which is staked down near one side of the slide. Other examples of such water slides are found in U.S. Pat. Nos. 2,982,547 and 4,762,316, and in British application G.B. 2,110,944 A, published Jun. 29, 1983.

There is a need for alternative slides which offer the child a variety of different experiences so that after he has played with and perhaps lost interest in one style of slide, he can switch to another style. Moreover, there is always a need for lower cost and more sturdy toys. Therefore, if a new sliding experience can be provided, it is good to do so at a lower cost and in a more reliable manner.

Accordingly, an object of the invention is to provide new and improved water slide games, at a lower cost, and with greater reliability.

Another object is to provide a slide with a spray of water delivered from multiple sources so that the child slides through a tunnel of water.

In keeping with an aspect of the invention, these and other objects are provided by a sheet of plastic material which is spread over a series of bumps that form a ramp for lifting the body of a sliding child. The bumps are completely separate items which are staked down independently of the plastic sheet so that less stresses are transferred from the sheet to the bumps. Water is sprayed from both sides of the slide in the vicinity of the bump so that the child travels through a tunnel of water along part of the slide. The design also features a sturdier staking system so that the anchoring points of the slide are much less likely to tear.

An embodiment of the invention is shown in the attached drawings, wherein.

Figure 1:
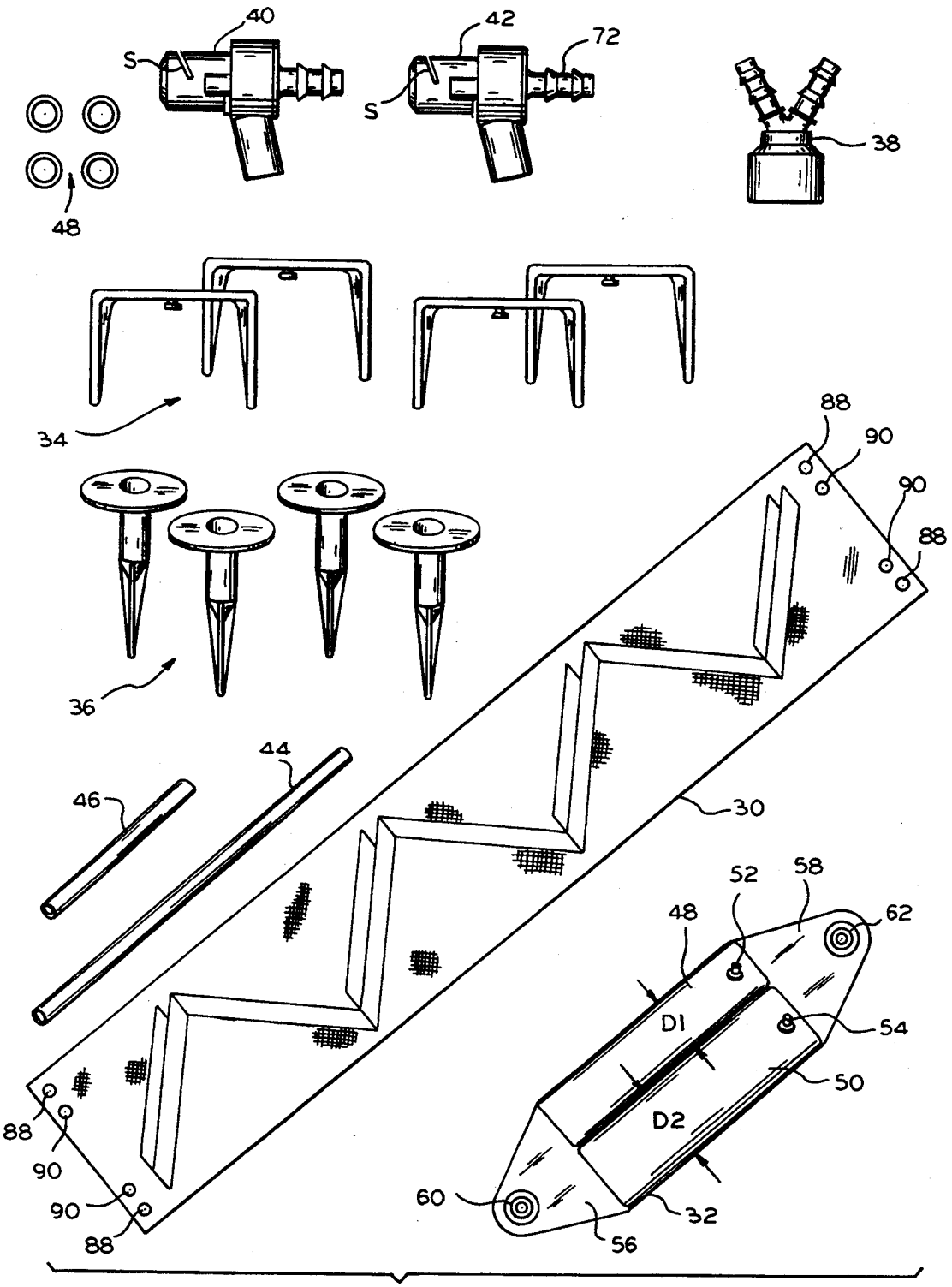
FIG. 1 shows the parts of the inventive toy water slide.

The parts of the toy water slide which a child receives when he buys a slide kit are shown in FIG. 1, as including: a sheet of preferably transparent plastic 30 which, in one example is 3×25-feet; an inflatable series of bumps 32; four U-shaped stakes 34; four oval stakes 36; a Y-fitting 38; two nozzles 40, 42; a long tube 44; a short tube 46; and four O-rings 48. Except for the rubber O-rings 48, all ejection molded parts are made of suitable plastic materials well known to those who are skilled in the art. Preferably, the exposed surface of slide 30 has graphics which are visible through the transparent plastic and which are designed to appeal to a child and further has by a relatively slick surface when wet. The graphics are printed on the back of the slide so that they are visible through the slide without presenting ink which could rub off on a child or reducing the slickness of the slide. Each of the stakes 34 is a U-shaped member with a button in the center of the bight of the U. The button is passed through holes in the corner of the slide which is then wrapped around the bight. Thereafter, the arms of the U-shape are pressed into the earth. Each oval stake 36 a tubular spike with a flange on the top. The tube may receive and lock an accompanying part in place.

The series of bumps 32 is formed by two confronting sheets of polyvinyl chloride plastic which have been suitably bonded peripherally to form two separate compartments 48, 50 which form a set of inflatable tubes. The configuration of the sheet and bonding creates inflated tubes with circular cross section which gives the best uniformity of stress within the walls of the polyvinyl chloride plastic. Conventional valves 52, 54 enable a person to separately blow up each of the compartments to form two inflatable tubes. The opposite ends of the confronting sheets which make the bumps are formed into tabs 56, 58 with grommets 60, 62, each of which grommets receiving an oval stake 36. In an uninflated condition, compartment 48 of one embodiment had a dimension D1 which was 7-inches wide. The other compartment 50 of this embodiment had a dimension D2 which was 9½-inches wide. Therefore, when they are inflated, the different diameters of compartments 48, 50 provide a graduate array of cylinders which together form an inflated ramp for lifting the sliding body of a child.

Figure 2:
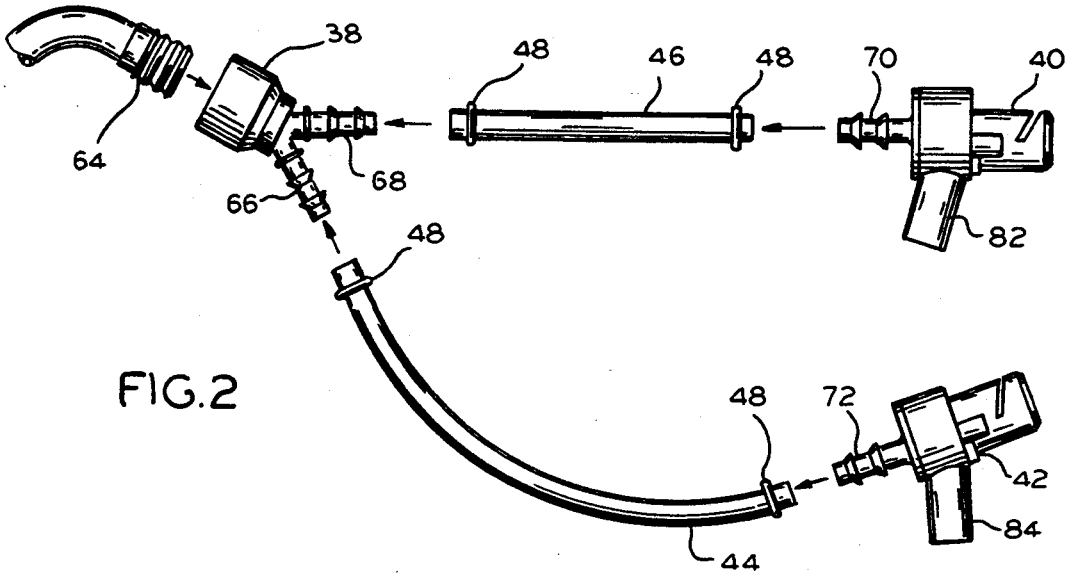
FIG. 2 is a perspective view of the water delivery system.
Figure 2A:
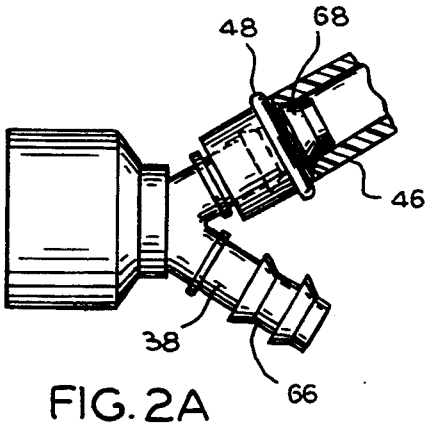
FIG. 2A shows the manner of connecting a hose to a Y-fitting and to nozzles.

The water delivery system begins with a garden hose having a conventional threaded end fitting 64 that receives a port having a mating thread formed at the stem end of a Y-fitting 38. The other two ends 66, 68 of the Y-fitting 38 are barbed to receive the ends of tubes 44, 46. Before the tubes 44, 46 are forced over barbed ends 66, 68, O-rings 48 are slipped over each of the tube ends and moved far enough to be out of the way. Then, the barbed ends are inserted into the ends of tubes 44, 46, after which the O-rings are rolled over the barbed ends to secure the tubes. As best seen in FIG. 2A, by way of example, O-ring 48 secures the end of tube 46 onto the barbed end 68. Each of the nozzles 40, 42 has a similar barbed end 70, 72 which is fitted into the opposite ends of tubes 46, 48 and then secured in place by O-rings 48, 48. The short tube 46 with the nozzle 40 is placed on the side of the slide which is nearest the garden hose. The long tube 44 with second nozzle 42 fits under the slide and is placed on the side of the slide which is remote from the garden hose.

Figure 4:
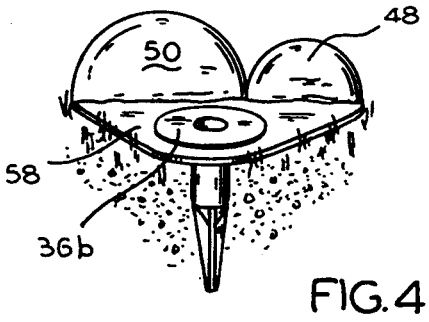
FIG. 4 is an end view of the series of bumps which is staked down.
Figure 3:
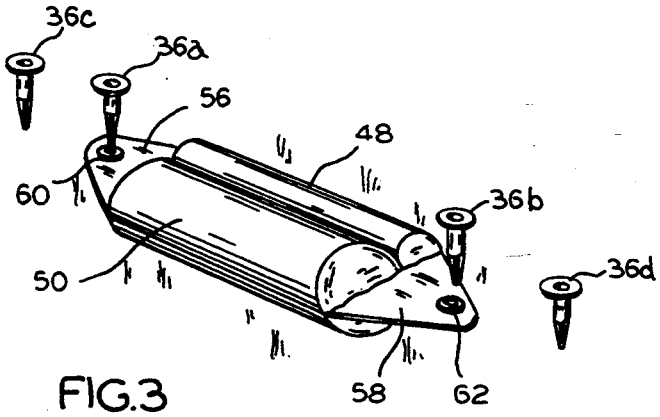
FIG. 3 is a perspective view of a series of bumps which is being staked down.
Figure 5:
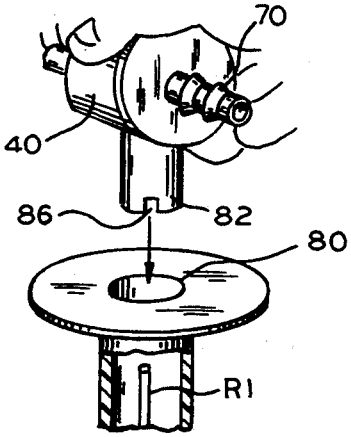
FIG. 5 is a perspective view of a nozzle being installed in an oval stake.

The series of tubular bumps 50, 48 is laid out on the ground at a place which will be at or near the middle of the slide (e.g. about 12½-feet from each end of the embodiment which uses 25-foot slide) and with the smallest diameter tube being nearest the start of this child's slide. The long tube is placed under preferably the larger bump 50 or in the space between the tubular bumps 50, 48. One of the oval stakes 36 is placed through each grommets, stake **36*a* (FIGS. 3,4) being here shown in grommet 60 and stake 36*b* in grommet 62. Approximately one foot out board of each of the stakes 36*a*, 36*b*, a second oval stake 36*c*, 36*d* is pressed into the earth. Each of these oval stakes includes a tubular opening 80 (FIG. 5) which has two diametrically opposed internal ribs, as at R1. Each of the nozzles 40, 42 (FIG. 2) has a dependent collar 82, 84 integrally associated therewith. The bottom of each collar has a pair of opposing notches, one such notch 86 being shown on collar 82 in FIG. 5. Therefore, the collar 82 may be inserted into tube 80 and rotated until the notches 86** fit over the internal ribs. The notches and ribs lock and orient the nozzles so that they spray water over the slide, from opposite sides thereof, thus forming a tunnel of water.

Figure 6:
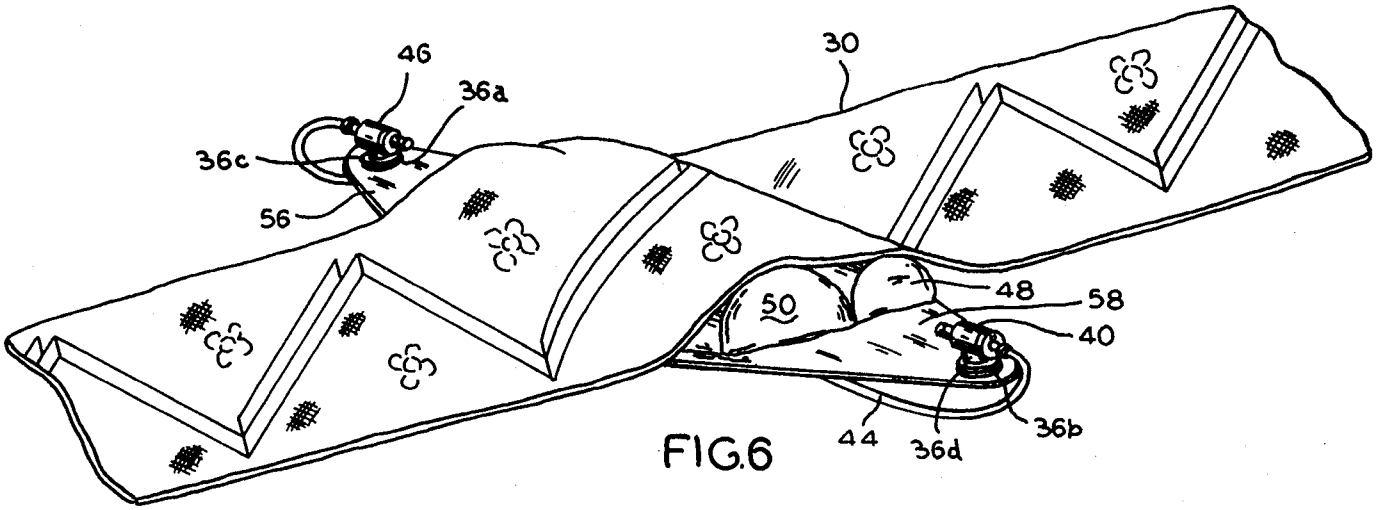
FIG. 6 is a perspective view of the slide in place over the staked down series of bumps.

Next, the slide 30 (FIG. 6) is laid on the surface of the ground and over the series of bumps 50, 48, under approximately the longitudinal center of the slide. On each corner of the slide, a pair of transversely spaced holes 88, 90, (FIG. 1) provide means for attaching the slide to a corner stake.

Figure 10:
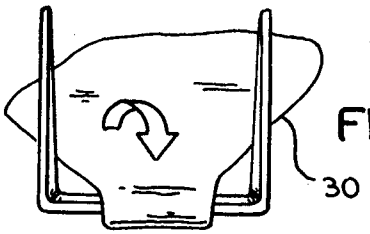
FIGS. 7–11 are four stop motion views showing how the slide is staked down.
Figure 11:
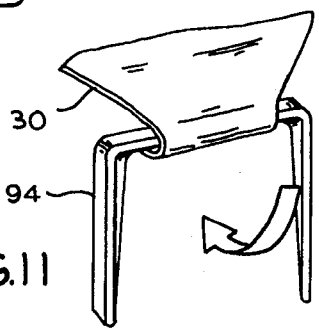
Figure 9:
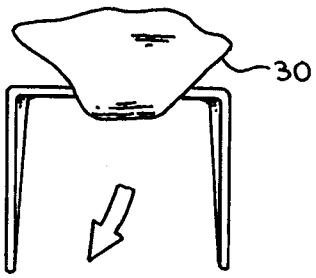
Figure 8:
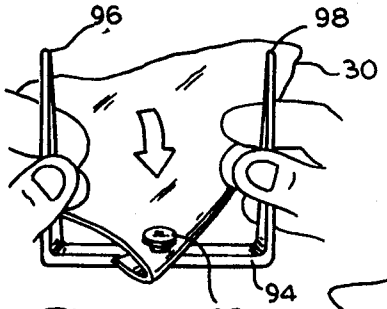
Figure 7:
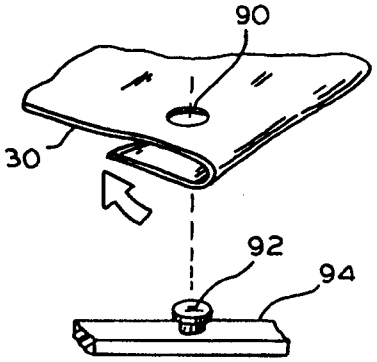

First, the slide is folded (FIGS. 1,7) with hole 90 directly over hole 88. Then, a button 92 on stake 94 is pressed through the aligned holes 88, 90. Next (FIG. 8), the legs 96, 98 are rotated several times (FIGS. 9, 10) to roll the corner of slide 30 around the stake. After two complete turns (FIG. 11), the stake 94 is pressed into the earth.

Figure 12:
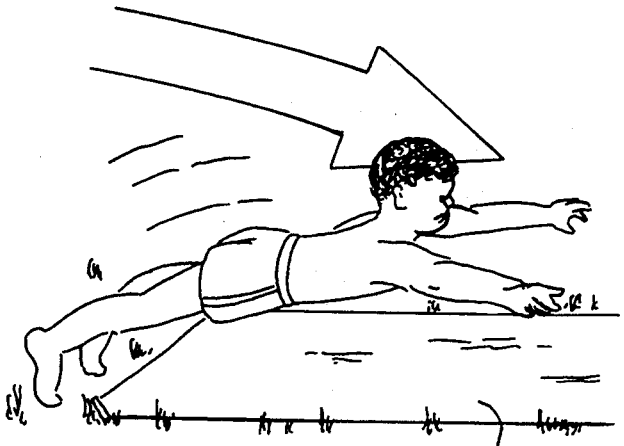
FIGS. 12–14 are three stop motion views of a child at play on the slide.
Figure 13:
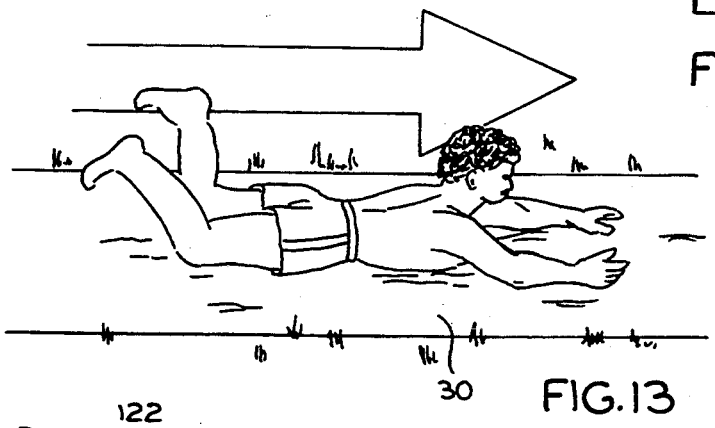
Figure 14:
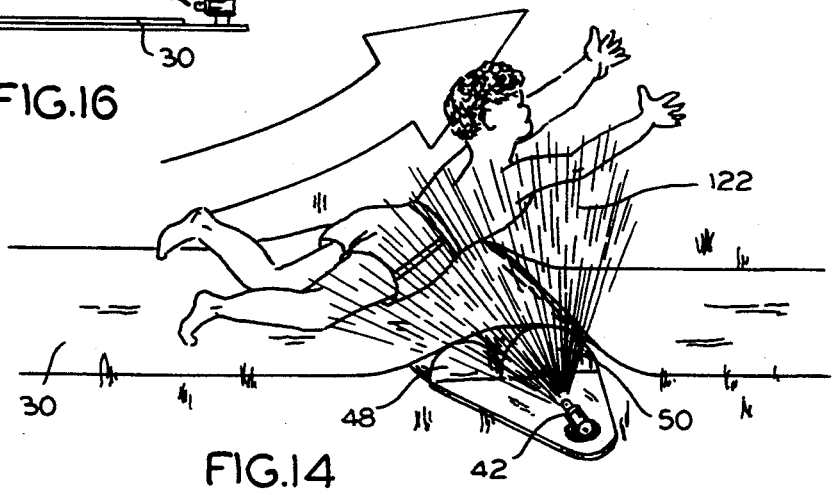

The water is turned on to wet the entire surface of the slide. The child runs toward the slide and in a direction which is substantially aligned with the long axis of the slide. The child belly flops on the slide (FIG. 12), with his arms outstretch in front of him. He slides over the wet surface (FIG. 13) toward the bumps. The bumps (FIG. 14) form a ramp which lifts the body of the child and seems to propel him into space. At this point, the nozzles are spraying a tunnel of water over the slide.

Each of the two nozzles 40, 42 (FIG. 1) is a closed cylinder with a circumferential, substantially semicircular slits S formed part of the way around the peripheral surface of the cylinder. The slit is angled toward the closed end of the cylinder so that the water spray emitted by the slit forms a sheet of water which is projected forward and around the sides of the cylinder. Thus, if one nozzle is placed on each side of and directed toward the slide, the resulting spray appears to form a tunnel of water for the child to slide through.

Figure 15:
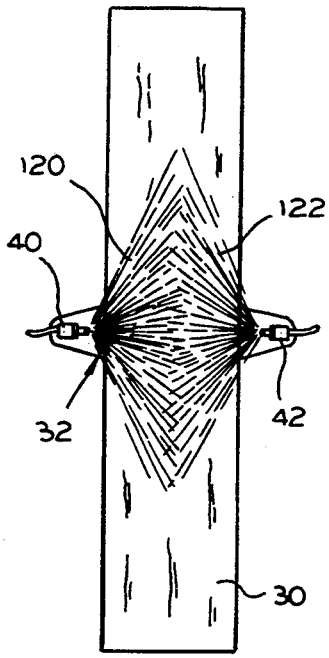
FIG. 15 is a plain view plastic sheet with the tunnel of water being sprayed over its.
Figure 16:
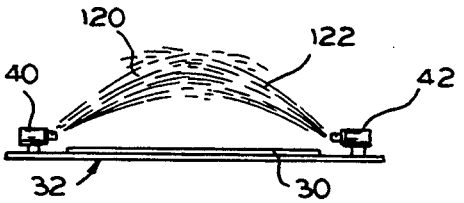
FIG. 16 is an end view of the slide with the tunnel of water arching over it.

The tunnel of water is shown in FIGS. 15, 16. The water emanates from slits S (FIG. 1) formed near a closed end of a cylinder that forms a nozzle. Under the city water pressure, the water is driven upward and outwardly as fan shaped sheets of water 120, 122 on opposite sides of slide 30 with the source of the fan adjacent the bumps 32.

As seen in FIG. 16, the sheets 120, 122 initially spray upwardly. As gravity takes over, the spray of water tends to curve over and form an arch. Thus, there is a tunnel of water over the slide 30 through which the child may slide.

Among other things this arrangement provides superior results under many semi-adverse conditions. For example, there may be times when the wind is blowing in a direction which might keep the spray for wetting the surface. With nozzles on both sides of the sheet, it is highly unlikely that the slide will dry. With children there might be a burn if they try to slide over a dry plastic.

Those who are skilled in the art will readily perceive how to modify the invention. Therefore, the appended claims are to be construed to cover all equivalent structures which fall within the true scope and spirit of the invention.

The claimed invention is:

1. A toy comprising a relatively piece of plastic having a surface which is slick when wet so that a child may slide on the surface of said plastic piece, an inflatable tubular structure having a series of cylindrical tubes with said piece of plastic passing over said tubes, each of the tubes in said series having a diameter which is smaller than the diameter of the next tube in said series so that said series of tubes forms a ramp to lift a child sliding over the wet plastic surface up off the plastic surface to propel the child into the air, a pair of nozzles, each of said nozzles being a closed cylinder with a circumferential slit formed around a part of the perimeter of the cylinder in order to deliver a sheet of water spray forward of said cylinder, means for independently staking down said piece of plastic, said series of tubes and said nozzles, and said nozzles delivering a spray from each side of the plastic toward said piece of plastic to form a tunnel of water in the vicinity of said series of tubes.

2. A water slide toy comprising an elongated piece of plastic with a longitudinal axis and having a surface which becomes slick when it is wet, an inflatable set of tubes of graduated diameter which together form a ramp positioned under the slide transverse to said longitudinal axis, means for delivering a spray of water from each side of said slide toward and over said slide, whereby said slide appears to go through a tunnel of water, and means for independently staking down said slide, said inflatable set of tubes, and said water spray delivery means, said means for staking formed from tubular members with a flange on the top and with diametrically opposed internal ribs within said tubular members, and said means for delivering a spray of water comprises at least one nozzle on each side of said surface, each of said nozzles having an integral dependent collar with notches therein which fits into said tubular member and lock in place over said ribs.

3. The water slide of claim 2 wherein each of said nozzles comprises a cylinder with a closed end and a generally semicircular circumferential slit formed a part of the way around a peripheral surface of the cylinder, said slit being angled with respect to a longitudinal axis of said cylinder for projecting a sheet of water ahead of and surrounding said axis, said nozzles being oriented toward said surface in order to form said tunnel of water over said surface.

4. A water slide toy comprising an elongated piece of plastic with a longitudinal axis and having a surface which becomes slick when it is wet, an inflatable set of tubes of graduated diameter which together form a ramp positioned under the slide transverse to said longitudinal axis, means for delivering a spray of water from each side of said slide toward and over said slide, whereby said slide appears to go through a tunnel of water, and means for independently staking down said slide, said inflatable set of tubes, and said water spray delivery means, said slide having four corners, each of said corners having a pair of transversely displaced holes formed therein, at least four of said means for staking being U-shaped members with a button in the center of the bight of the U, said button fitting through said holes when said sheet is folded to align said holes, whereby said U-shaped members may be turned to wrap the piece of plastic around the bight of the U-shape.

5. A water slide toy comprising an elongated piece of plastic with a longitudinal axis and having a surface which becomes slick when it is wet so that a child may slide on the surface of said slide, an inflatable set of tubes of graduated diameter which together form a ramp positioned under the slide transverse to said longitudinal axis to lift a child sliding over the surface of said slide up off the plastic surface to propel the child into the air, a pair of nozzles for delivering a spray of water from each side of said slide toward and over said slide to form a tunnel of water in the vicinity of said set of tubes, and means for independently staking down said elongated piece of plastic, said set of tubes and said nozzles.

* * * * *